US005310271A

United States Patent [19]

Andou et al.

[11] Patent Number: 5,310,271

[45] Date of Patent: May 10, 1994

[54] SOLENOID ACTUATOR

[75] Inventors: Hirokazu Andou; Hideaki Ishimizu; Mitsuru Kishimoto; Masayuki Ishikawa, all of Tokyo, Japan

[73] Assignee: Oki Electric Industry Co., Ltd., Tokyo, Japan

[21] Appl. No.: 866,857

[22] Filed: Apr. 10, 1992

[30] Foreign Application Priority Data

Apr. 30, 1991 [JP] Japan ..... 3-128543

[51] Int. Cl.[5] ..... B41J 2/235

[52] U.S. Cl. ..... 400/124; 101/93.05

[58] Field of Search ..... 101/93.05; 400/124

[56] References Cited

U.S. PATENT DOCUMENTS

| | | | |
|---|---|---|---|
| 4,010,836 | 3/1977 | Bernardis et al. | 400/124 |
| 4,326,999 | 4/1982 | Fink et al. | 106/38.22 |
| 4,433,926 | 2/1984 | Isobe et al. | 400/124 |
| 4,886,381 | 12/1989 | Kersey | 101/93.05 |
| 5,042,375 | 8/1991 | Grüner eta l. | 101/93.05 |
| 5,054,942 | 10/1991 | Bernardis et al. | 101/93.05 |
| 5,073,051 | 12/1991 | Gugel et al. | 400/124 |

*Primary Examiner*—Edgar S. Burr
*Assistant Examiner*—John S. Hilten
*Attorney, Agent, or Firm*—Spencer, Frank & Schneider

[57] ABSTRACT

A print head has a solenoid driving means which employs a filler mixed with a lubricating oil to fix an exciting coil to the core. The filler prevents the layer winding from being shorted due to corrosion of the exciting coil and prevents mechanical abrasion of the armature by supplying lubricating oil during extended operation.

7 Claims, 2 Drawing Sheets

SOLENOID ACTUATOR

BACKGROUND OF THE INVENTION

1. Field of the Invention

The present invention relates to a solenoid actuator for driving a movable portion of the solenoid actuator utilizing electromagnetic force. In particular, it relates to a filler for encapsulating the exciting coil of the actuator and means for isolating the filler from the movable portions of the actuator.

2. Description of the Related Art

As a solenoid actuator there is a wire dot print head which is used as a printing means for a printer.

A print head of this type is generally provided with armatures each connected to a print wire and a solenoid driving means for attracting the attraction of and releasing the attraction of the armature.

The solenoid driving means comprises a permanent magnet and an electromagnet for canceling the attraction of the permanent magnet. The electromagnet comprises a core and an exciting coil which is wound around a convex region of the core.

The exciting coil is fixed to the core by a filler such as an epoxy resin, silicone resin, or the like. The filler has a function of radiating heat generated in the exciting coil outside the solenoid driving means.

However, when the epoxy resin is used as the filler, the epoxy resin is chemically dissolved when the internal temperature of the print head exceeds 150° C. during a printing operation whereby the dissolved epoxy corrodes B the covering member which is employed in the exciting coil, which generates the problem that the layer winding of the exciting coil is shorted.

If a silicone resin is used as the filler, it has a high viscosity and is very difficult to fill uniformly inside the solenoid actuator.

Since silicone resins can absorb low viscosity polymer oils, the resins absorb a lubricating oil which is applied between the core and the armature for preventing an abrasion caused by the striking between the core and the armature, which results in the abrasion thereof when a printing operation is carried on for a long period of time.

When the internal temperature of the print head rises to between around 100° C. to 120° C. due to the heat generated from the exciting coil for extended printing operations, silicon in the silicone resin reacts with oxygen whereby an extracted low polymer cyclohexane compound enters between the core and the armature, which hinders the armature from moving.

To solve the problems set forth above, there is a method to regulate the viscosity by mixing the low viscosity silicone oil with the silicone resin. However, such a problem remains unsolved in this method in that the absorption of the lubricating oil by the silicone resin increases.

SUMMARY OF THE INVENTION

It is a first object of the invention to provide a solenoid actuator capable of preventing the layer winding of the exciting coil from being shorted.

It is a second object of the invention to provide a method of manufacturing a solenoid actuator capable of the complete filling of a filler around the periphery of the exciting coil.

To achieve the above object, the solenoid actuator according to the present invention comprises a movable portion of an actuator, an exciting coil wound around a core for driving the movable portion and a filler mixed with an oil for embedding the exciting coil therein.

The method of manufacturing a solenoid actuator according to the present invention comprises the steps of providing an exciting coil in an actuator body, dropping silicone resin, which is reduced in viscosity by being mixed with an oil, in the base body of the solenoid actuator and filling the same silicone resin in the actuator body.

DESCRIPTION OF THE PREFERRED EMBODIMENT

Figure 3:
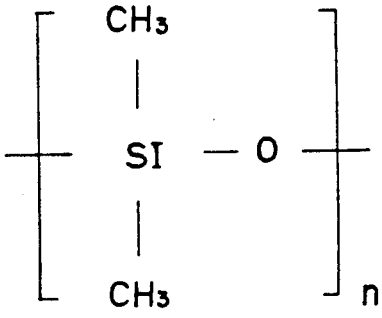
FIG. 3 is the molecular formula of a silicone resin.

A solenoid actuator according to the preferred embodiment of the present invention will be described hereinafter with reference to FIGS. 1 to 3.

Figure 1:
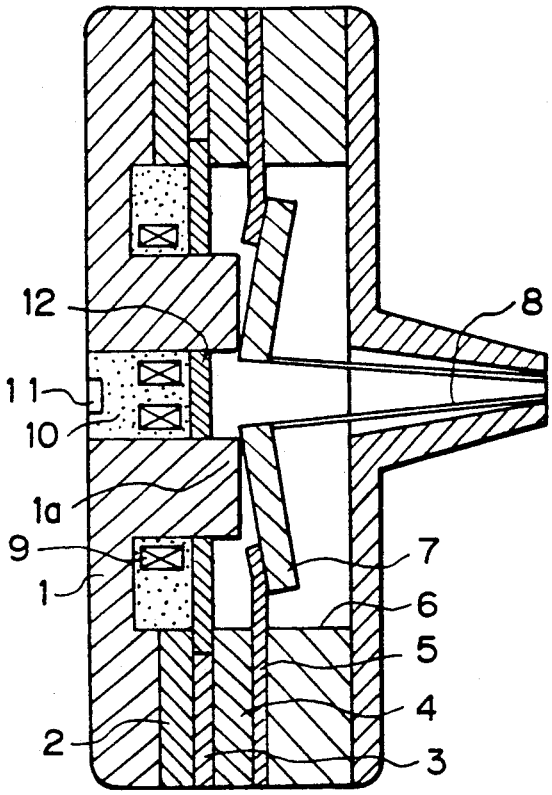
FIG. 1 is a cross-sectional view of a solenoid actuator according to a preferred embodiment of the present invention.

FIG. 1 is a cross-sectional view of a spring charge type wire dot print head. In the same figure, a wire dot print head comprises a core 1, an annular or first yoke 2 which is layered on the periphery of the core 1, a second yoke 3 provided on the first yoke 2, a permanent magnet 4, a leaf spring 5 and a third yoke 6. The leaf spring 5 supports an armature 7 elastically. The core 1 has a convex portion 1*a* inside the wire dot print head and an exciting coil 9 is wound around the convex portion 1*a* for cancelling the magnetic field of the permanent magnet 4. The exciting coil 9 is embedded in a filler 10 whereby the exciting coil 9 is fixed to the filler 10 for radiating the heat. A temperature detecting thermistor 11 is also embedded in the filler 10 for detecting the internal temperature of the print head. The filler 10 is covered by a filler cap 12. A part of a patch, described later, adjacent to the convex portion 1*a* of the core 1 for guiding wires of the exciting coil 9 and the thermistor 11 out of the print head is not shown.

The operation of the wire dot print head will be described briefly hereinafter.

When the exciting coil 9 is not energized, the magnetic flux of the permanent magnet 4 passes through the first yoke 2, the core 1, the armature 7, the third yoke 6 and returns to the permanent magnet 4 so that a magnetic attraction is generated between the convex portion 1*a* of the core 1 and the armature 7. The armature 7 is attracted by the core 1 while it biases the leaf spring 5 by the attraction.

When the exciting coil 9 is energized at this stage, the magnetic flux generated by the exciting coil 9 cancels the magnetic flux generated by the permanent magnet 4 between the convex portion 1*a* of the core 1 and the armature 7. The biased leaf spring 5 is released when the magnetic flux generated by the permanent magnet 4 is cancelled. As a result, a print wire 8 fixed to a free end of the armature 7 strikes a printing medium, not shown, by way of an ink ribbon whereby dot printing is carried out.

When such a printing operation is carried out for a long time, the temperature of the interior of the wire dot print head rises due to heat produced by the current applied to the exciting coil 9 and an eddy-current loss is generated in the core 1 so that the temperature of the exciting coil 9 rises. The thus generated heat is conducted to the thermistor 11 through the filler 10 and is detected by the thermistor 11 as temperature.

The dot print head having the structure set forth above is manufactured as follows.

The annular first yoke 2 and the second yoke 3 are layered on and fixed to the circumferential edge portion of the core 1 to thereby assemble the solenoid actuator portion of the wire dot print head. The exciting coil 9 is embedded around the convex portion 1*a* of the first yoke 2 while the thermistor 11 is disposed in the solenoid actuator portion of the wire dot print head at a position in which it does not contact the core 1 or the exciting coil 9.

At this stage, the filler 10 is potted in the solenoid actuator portion of the wire dot print head. Since the filler 10 has a low viscosity, described hereinafter, it penetrates into the gap defined around the convex portion 1*a* of the core 1 and spreads out in the lower half portion of the wire dot print head. In this case, the portion under the thermistor 11 is preferably clogged by the patch. The filled filler can be hardened by heating it for about three hours at 130° C.

Successively, a filler cap 12 is placed on the filler 10 while the permanent magnet 4, the leaf spring 5 and the third yoke 6 are layered on and fixed to the second yoke 3 in turn. The permanent magnet 4, the leaf spring 5 and the third yoke 6 are preferably previously assembled as the upper half portion of the wire dot print head.

The filler 10 will be described in more detail. A silicone resin, which has the molecular formula illustrated in FIG. 3, is employed as the filler 10. The preferred silicone resin is, e.g. a product called as KE1204 manufactured by The Shin-Etsu Chemical Co. Ltd. and becomes red and gummy after it has hardened. Two liquids are mixed with each other consisting of a main agent and a hardening agent and are hardened by heat after mixing with each other. The viscosity of the mixture of the main agent and the hardening agent is about 35 centipoise and does not penetrate the gap defined between the core 1 and the exciting coil 9 at this viscosity.

In order to reduce the viscosity of the silicone resin, after the two liquids are mixed with each other, a machine oil having a viscosity of 35 centipoise is mixed with the silicone resin wherein the ratio of the machine oil to the silicone resin is 3:10 by weight. As a result, the viscosity of the silicone resin is reduced to about 15 centipoise. It is possible to fill the filler 10 composed of the silicone oil into every nook and corner of the complicated internal structure of the wire dot print head at such a viscosity. When the print head, in which the filler 10 is filled, is more complicated, the amount or the viscosity of the machine oil to be mixed with the silicone oil is varied to thereby regulate the viscosity of the filler 10 so that the filler is sufficiently filled in the gap.

The oil to be mixed with the silicone resin is preferably of the same component as the lubricating oil so as to prevent abrasion caused by striking between the metals which constitute the convex portion; 1*a* of the core 1 and the armature 7 serving as the movable portion or an oil which does not react with the silicone resin. As the oil having the same component as the lubricating oil, there is the oil comprised mainly of a synthetic hydrocarbon or a mineral oil, e.g. SHINLUB compressor oil SB (name of product produced by Nippon Steel Chemical Co., Ltd.).

The filler cap 12 comprises a paper or a felt. Since the paper or the felt is superior in absorbing or retaining oil, it is possible to supply the lubricating oil to the driving portion for a long time because the paper or the felt absorbs the lubricating oil sufficiently.

Figure 2:
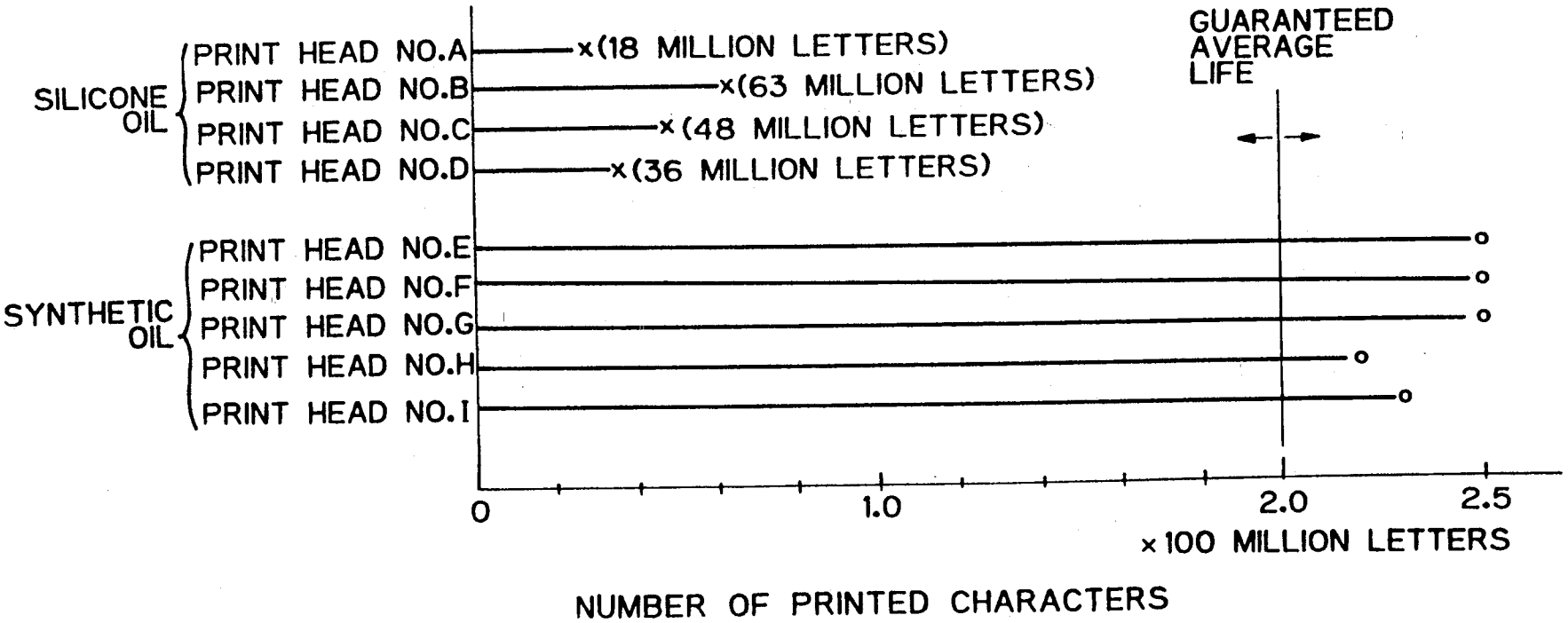
FIG. 2 is a graph showing a comparison life test of wire dot print heads for cases in which the viscosity of a filler is reduced by a silicone oil and by another oil.

FIG. 2 is a graph showing a comparative test of the lifetimes of wire dot print heads A to D employing a filler 10 comprising a mixture of silicone oil and silicone resin and having low viscosity, and the lifetimes of wire dot print heads E to I employing a filler 10 according to the present invention. The silicone oil to be mixed with the silicone resin is a dimethyl silicone oil called KF 96 produced by The Shin-Etsu Chemical Co., Ltd.

The lives of the wire dot print heads A to D usually expire when they print 20 million to 60 million characters while the lives of the wire dot print head E to I do not expire even if they print more than 200 million characters. The reason why the lives of the wire dot print head E to I are extended is that the lubricating oil, which is applied between the core 1 and the armature 7, is not absorbed by the filled silicone resin. On the contrary, the oil in the oversaturated state is stored in the silicone resin and this oil or the oil absorbed by the filler cap 12 is supplied to the movable portion as a lubricating oil. Accordingly, abrasion in the movable portion is reduced.

Even if the internal temperature of the wire dot print head exceeds 130° C. which is the hardening temperature where it is used in practice, the volatile low silicon polymer compound is reduced in the absolute amount thereof since the machine oil is used as an additive so that the adverse effect caused by the low viscosity silicon polymer is reduced.

Furthermore, since a sufficient amount of the lubricating oil is applied on the surface of core 1, the internal temperature of the wire dot printer is not liable to rise even if the striking between the core 1 and the armature 7 is repeated during the printing operation and production of silicon dioxide is reduced.

In order to improve the reliability of the wire dot print head, the inner diameter of the annular second yoke 3 is increased. Also, filler cap 12, which is composed of a rubber sheet which does not contain components such as sulfur, nitrogen oxide, organic metallic salt and a phosphoric compound which prevent the silicone resin from being hardened, is placed on the filler 10 so as to completely cover the filler 10 and the second yoke 3 is clamped by the first yoke 2 and the permanent magnet 4. In such a manner, it is possible to shut the filler 10 from the atmosphere of the armature 7 serving as the movable portion. As a result, it is possible to restrain the low viscosity silicon polymer compound from volatilizing and to thereby stabilize the operation of the armature. Since the filler 10 is shut off from the atmosphere, the moisture in the air is shut off so that the filler 10 does not absorb the moisture. Accordingly, the production of silicone oxide is reduced so that a more stable mechanical property can be obtained in the wire dot print head. If the filler cap 12 employs a magnetic body such as a metal plate, etc. instead of the rubber sheet, such an additional peculiar effect can be obtained that the filler cap 12 can control the magnetic flux generated by the permanent magnet 4.

When an epoxy resin is employed as the filler 10, it is restrained from absorbing moisture by the filler cap 12 so that the resin can be prevented from dissolving at high temperature, and the wire coating member and the wire metal portion of the exciting coil 9 can be respectively prevented from corroding.

According to the embodiments set forth above, the filler employs two liquid type hardening silicone resins which harden by reacting with the moisture in the air but can employ one liquid type hardening resin, wherein the latter case has the same effect as the former case.

Furthermore, the present invention is not only adapted for a wire dot print head but to an apparatus incorporating the solenoid actuator wherein the latter case has the same effect as the former case.

Described hereinafter is an example of a case where a filler is employed to fix the exciting coil of a DC brushless motor. In this case, the exciting coil corrodes at high temperature and the low viscosity polymer filler located between the rotor and the stator impedes the rotary motion of the rotor. The silicone resin is employed as a filler while a lubricating oil such as machine oil, synthetic oil, etc. is mixed with a silicone resin, whereby a low viscosity polymer is generated and the stable operation can be continued for a long time. Likewise, when an epoxy resin is employed as a filler, it is possible to extend the life of the solenoid actuator by isolating the surface of the filler, in which an exciting oil is embedded, from other portions.

As explained above, according to the present invention, since a lubricating oil such as a synthetic oil, machine oil, etc. is mixed with a silicone resin, the following effects can be achieved.

It is possible to fill the filler in a complicated internal structure and also possible to restrain the mechanical abrasion. It is further possible to eliminate an operation failure of the movable portion caused by the influence of a lower viscosity polymer compound which is produced from the filler. Still furthermore, the effects set forth above can be achieved by shutting off the filler from the interior space by forming a shut off layer therebetween. It is possible to restrain the filler from absorbing moisture whereby the adverse effect given to the coil in the actuator by the filler involved in moisture absorption can be eliminated.

What is claimed is:

1. A solenoid actuator having a longitudinal axis comprising:

a core member having an annular portion defining an internal axial cavity surrounding said longitudinal axis, said core member being composed of a ferromagnetic substance;

an exciting coil wound around said core member;

an armature disposed adjacent said core member and coaxial with said longitudinal axis;

lubricating oil located between said core and said armature; and an internal filler positioned within the cavity in said core member for fixing the exciting coil to the core member, said internal filler being composed of silicone resin oversaturated with an oil having the same composition as said lubricating oil and providing additional lubrication to the armature.

2. A solenoid actuator according to claim 1 wherein said internal filler has an upper surface adjacent said armature, and wherein a filler cap is provided on the entire upper surface of the filler for isolating the filler from the atmosphere inside the solenoid actuator.

3. A solenoid actuator according to claim 2, wherein the filler cap comprises a fiber member saturated with the oil.

4. A solenoid actuator according to claim 2, wherein the filler cap is made of a rubber sheet.

5. A solenoid actuator according to claim 2, wherein the filler cap is formed of a magnetic substance.

6. A solenoid actuator according to claim 1, wherein said lubricating oil has a viscosity of at least 35 centipoise.

7. A solenoid actuator according to claim 1, wherein said lubricating oil is machine oil.

* * * * *